United States Patent [19]

Allwin

[11] Patent Number: 4,482,014

[45] Date of Patent: Nov. 13, 1984

[54] BARRIER TOOL FOR POLISHED BORE RECEPTACLE

[75] Inventor: Roger P. Allwin, Midland, Tex.

[73] Assignee: MWL Tool & Supply Company, Midland, Tex.

[21] Appl. No.: 397,680

[22] Filed: Jul. 12, 1982

[51] Int. Cl.[3] ..... E21B 23/02

[52] U.S. Cl. ..... 166/136; 166/217

[58] Field of Search ..... 166/208, 217, 136; 285/18, 316

[56] References Cited

U.S. PATENT DOCUMENTS

| | | | |
|---|---|---|---|
| 3,489,221 | 1/1970 | Crain et al. | 166/208 |
| 3,856,081 | 12/1974 | Canalizo | 166/217 |
| 3,933,202 | 1/1976 | Ahlstone | 166/208 |
| 4,109,728 | 8/1978 | Sanford | 166/217 |
| 4,139,059 | 2/1979 | Carmichael | 166/208 |

*Primary Examiner*—Ernest R. Purser
*Assistant Examiner*—Mark J. Del Signore

[57] ABSTRACT

The present invention relates to a method and apparatus for providing a sliding seal at the upper end of a polished bore receptacle in a wellbore to permit reciprocation of tubing string and to prevent the accumulation of debris in an annulus between a tubing string and a polished bore receptacle. In particular, a slideable and releasable connection is provided on a tubing string to releasably inner-connect with the upper end of a tubular bore in a wellbore and permit a sliding and sealing relationship there between.

5 Claims, 5 Drawing Figures

FIG. 1A
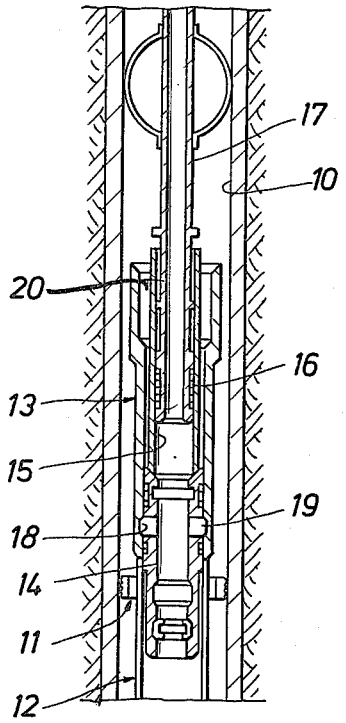
FIG. 1B
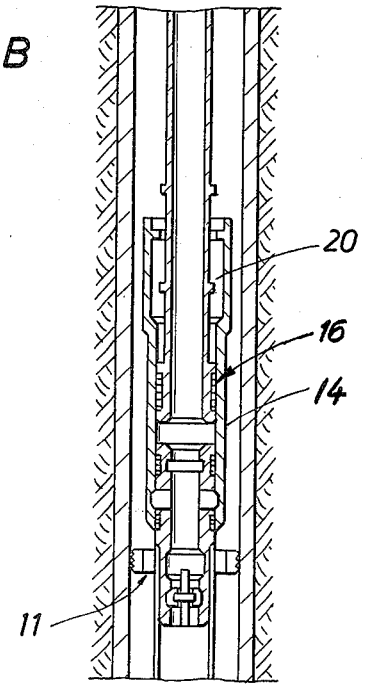
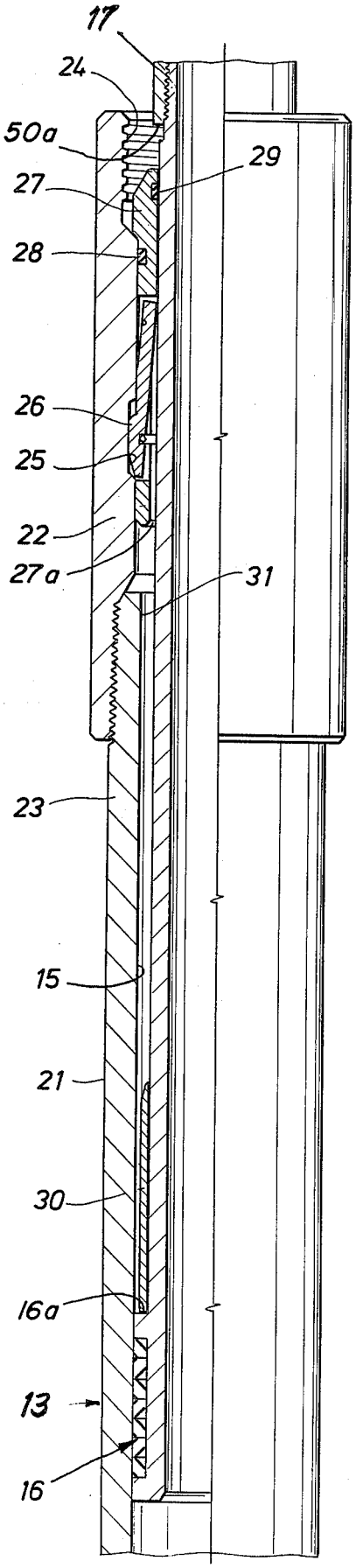
FIG. 2

BARRIER TOOL FOR POLISHED BORE RECEPTACLE

FIELD OF THE INVENTION

This invention relates to well tools, and more particularly, to well tools for use in a wellbore wherein it is necessary to protect an annulus between a tubing string and well tool from accumulating solids from wellbore fluids while permitting a sliding relationship.

BACKGROUND OF THE PRIOR ART

In the completion of oil wells, in one type of process a tubular well tool assembly is run into the wellbore above a production liner and a liner hanger. The liner hanger is adapted to be seated in the wellbore and cemented in place. The tubular well tool assembly above the liner hanger is adapted to receive a retrievable tubular receptacle. Either the receptacle or the well tool assembly is arranged with a polished bore to sealing and slideably receive a tubular assembly. The sliding and sealing relationship of the tubular member permits an attached tubing string to lengthen or shorten due to environmental effects in the well bore during operation of the well. Thus, the polished bore sliding seal between the tubing string and downhole equipment permits the tubing string to shift under different temperatures and pressures.

One of the difficulties that occurs with use of this kind of equipment is that there is an open annulus between the sliding seal and the upper end of the tubular well tool assembly where solids from oil well drilling fluids may precipitate out and tend to clog up the assembly.

The present invention is intended to eliminate the precipitation of solids in the annulus between a tubing string and the upper end of a tubular well tool assembly. In the present invention, the tubular well tool assembly is provided with a releasable latching device to cooperate with a latching groove in the upper end of the tubular well tool assembly to provide a removable barrier which prevents precipitation of solids from the wellbore into the annulus between the tubing and the tubular well tool assembly.

DESCRIPTION OF THE INVENTION

The present invention includes a tubular cage member slidably mounted on a tubing string between upper and lower flanges on the tubing string. Below the lower flange, the tubing string has a sealing member in a tubular well tool which is adapted to be slidably and sealingly reciprocated with respect to the tubular well tool. The upper end of the well tool has an internal annular locking groove and the cage member on the tubing string has locking fingers adapted to releasably latch the cage member in a fixed position to the upper end of the well tool by engagement with the annular locking groove. The upper flange guides the cage member into a latching position and the section of the tubing string between the flanges is movable longitudinally relative to the cage in its latching position. "Leaky" seals are provided between the cage, the tubing and the well tool so as to prevent passage of solids but not provide a pressure tight interface. At the lower flange is an enlarged diametrical portion which is adapted to be received within the cage member to unlatch the latching members so that the cage member can be retrieved with the tubing string when desired.

DESCRIPTION OF THE DRAWINGS

FIGS. 1(*a*) and 1(*b*), two different types of well tool assemblies are shown in cross-section in a schematically well bore, each of which can utilize the present invention;

FIG. 2 illustrates in cross-section the general arrangement of the present invention in schematic form;

DESCRIPTION OF PREFERRED EMBODIMENTS

Figure 3:
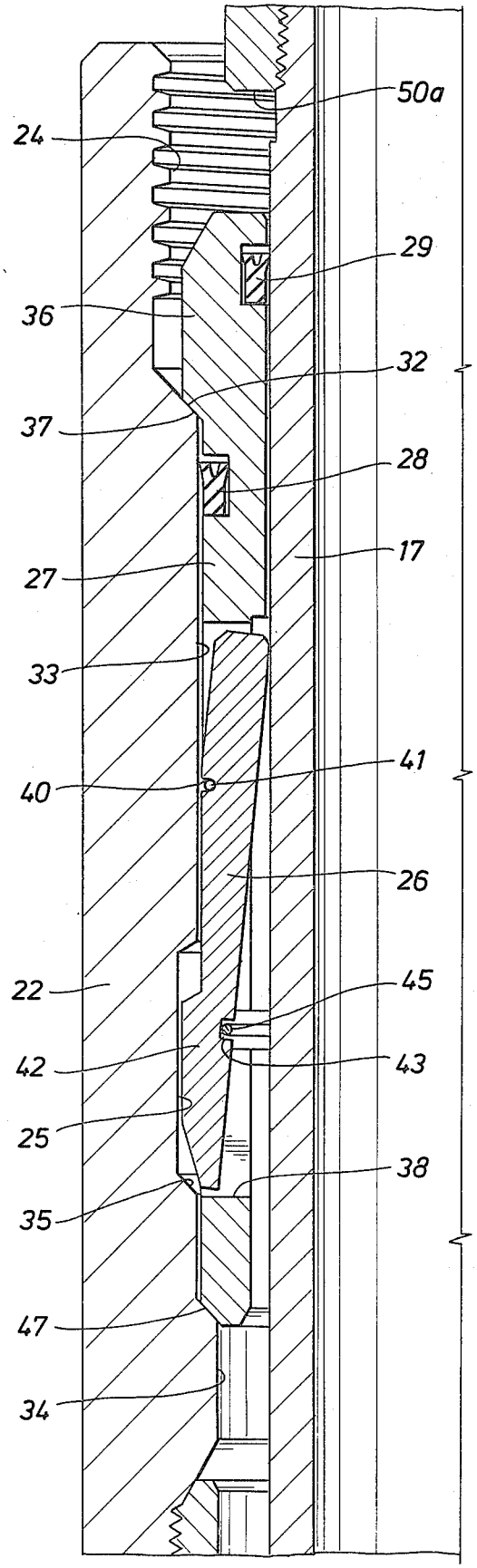
FIG. 3 is an enlarged view in cross-section of the barrier of the present invention.

In a typical oil well configuration illustrated in FIG. 1(*a*), the wellbore 10 which traverses the earth formations has a liner hanger 11 which is set in the wellbore in a conventional manner. Attached to the liner hanger 11 is a depending tubular liner 12 which can be cemented in place. Above the liner hanger and threadably connected to it 11 is a Polished Bore Receptacle (PBR) 13 which is provided to facilitate production operations on the well.

Inside PBR 13 is a retrievable Landing Assembly (RLA) 14 which can be selectively set or released for removal. The landing assembly may be of the type disclosed in Ser. No. 274,170 filed June 16, 1981 in the name of Hiram E. Lindsey, Jr. When removed from the receptacle 13, the receptacle 13 has a "full bore" opening. When the RLA 14 is latched in place, the RLA 14 permits use of setting plugs or the like to close off the bore.

The Polished Bore Receptacle 13 has a landing groove 18 which receives selectively operable locking latches 19 on the retrievable Landing Assembly. As noted before, the retrievable Landing Assembly 14 may be unlatched from the bore of the Polished Bore Receptacle 13 to provide a full opening to the liner 12. The retrievable Landing Assembly 14 has a polished bore 15 which slidably receives a sealing member seal assembly 16 which is attached to a tubing string 17. The end surface 50*a* of a coupling sub or joint of tubing together with the sealing assembly 16 define a tubular member adapted for coupling with a string of tubing.

In FIG. 1(*b*), a modified tool is illustrated wherein the sliding seal assembly 16 on the tubular string is received in a smaller polished bore connected to the retrievable landing assembly 14. The sealing assembly 16 is also adapted to slide relative to the polished bore 15 as the tubing string elongates or shortens during production. In both FIGS. 1(*a*) and 1(*b*), the tools have an open annular space 20 between the sliding seal assembly 16 and the upper end of the well tool. The annular space 20 is subject to collection of solids which precipitate out from the well fluids during the well operations and tend to clog up the space so that the unit may not slide freely with respect to the bore.

Referring now to FIGS. 2 and 3, at the upper end 21 of a Polished Bore Receptacle 13 is shown with a polished interior bore 15. The interior bore 15 is adapted to slidably and sealing receive a sealing assembly 16 coupled to the tubing string 17. A tubular latching sub member 22 is threadedly attached to the upper end 23 of the PBR 13 and has an upper interiorly threaded bore 24 which is adapted to releasably couple with a setting tool (not shown). For further details as to a setting tool and a retrievable landing assembly, reference may be made to a co-pending application Ser. No. 274,170, filed June 16, 1981 and assigned to the assignee of the present invention.

The latching sub member 22 has an annular latching recess 25 which is adapted to receive latching fingers 26 disposed within vertical slots circumferentially spaced about a tubular cage member 27. The latching fingers 26 are resiliently biased outwardly and are pivotally mounted with respect to a tubular cage 27. At the upper end of the cage 27 are inner and outer leaky seals 28, 29 for slidably closing off the annular space 31 between the tubing 17 and the latching sub member 22.

At the lower end of the tubing 17 is a sleeve 30 which is attached to the tubing 17 at a location just above the packing or seal assembly 16*a*. The sleeve 30 has an outer diameter sized to pass under the inner bore at the lower end of the cage 27 and to engage the inner surfaces of the fingers 26 thereby to pivot the fingers into the body of the cage member 27 and release the ends of the latching fingers 26 from the latching groove 25.

Referring now to FIG. 3, the latching mechanism is shown in an enlarged view. As shown in FIG. 3, the tubular latching sub 22 includes an internal threaded bore section 24, and an upper, tapered wall section 32 which extends to an inner bore 33. Below the inner bore 33 is a recess or annular groove 25 for receiving latch members 26. Below the recess or groove 25 is a smaller bore section 34 so that there is an upwardly facing shoulder 47. On the tubing member 17 is a tubular cage member 27 having an upper head portion 36 with an enlarged flange portion forming downwardly facing shoulder 37 to engage with the upwardly facing shoulder 32. The upper head portion 36 also has an inner and outer annular seal members 28 and 29 for closing off the bore 33 of the sub 22 and the outer surface of the tubing 17 yet not create a pressure seal.

Intermediate the length of the cage member 27 are vertical and rectangularly shaped openings 38 disposed about the circumference of the cage member 27. In the vertical openings 38 are elongated latching members 26 each of which are provided with a transverse groove 40 so that an annular ring member 41 inserted in each of the grooves provides a pivot point for the latch members. The lower end of the latch members 26 each have an outer latching finger 42 which is adapted to be received within the latching groove 25. An internal groove 43 in each of the latch members 26 receives a ring shaped spring 45. The spring biased ring 45 serves to pivot the lower end of the latch members 26 outwardly into engagement with the latching groove 25. The lower end of the cage member 27 has a downwardly facing shoulder 47 which engages the upwardly facing shoulder in the sub 22.

To insert the tool in the well, the end face 50*a* of a tubing engages the upper end of the cage member 27 and remains in contact therewith until the shoulders 47 and 32 engage. At this time, the latch fingers 26 engage the recess 25. Then the tubing string 17 may be lifted relative to the cage member 27 and be slideable relative thereto but the seals 28 and 29 block off the annulus at upper end of the sub 22 to prevent solids from precipitating into the annulus between the tubing and the sub.

When it is desired to remove the tubing, an upward pull on the tubing string 17 brings the sleeve member 30 on the lower end of the tubing member 17 under the latching fingers 26 to pivot them inwardly from their latching engagement with the recess 25. Subsequently, an upperwardly facing shoulder or flange 16*a* on the sealing assembly 16 engages the lower end of the cage member at shoulder 27*a* so that it may be retrieved along with the tubing string from the wellbore.

Figure 4:
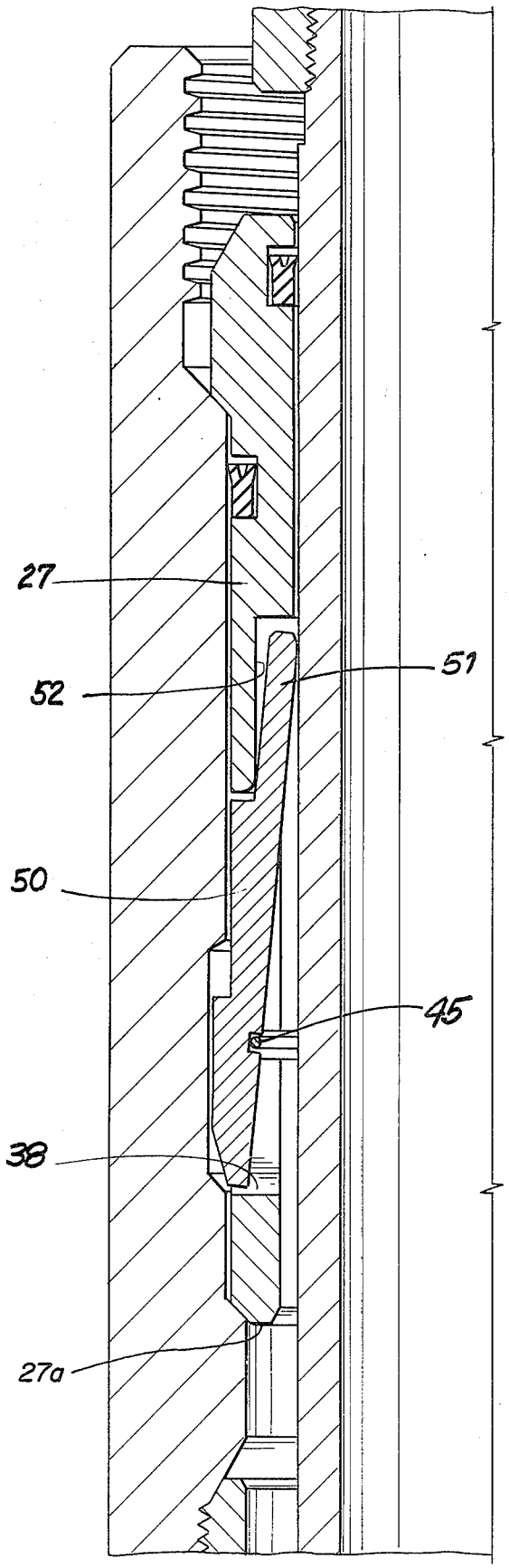
FIG. 4 is an enlarged view in cross-section of another form of the barrier of the present invention.

Referring now to FIG. 4, a different form of latching finger 50 is illustrated. In FIG. 4, the latching finger 50 has an upper finger portion 51 which is received under an annular recess 52. The annular recess 52 is formed in the cage 27 just above the openings 38. When the sleeve 30 (see FIG. 2) is disposed beneath the finger portions 51 the fingers 50 are held in place in a retracted condition. When the sleeve is removed, the fingers 50 are urged resiliently outward by the spring 45.

While various embodiments are illustrated, the scope of the invention is included within the claims which follow.

What is claimed is:

1. In a well tool for use in a well bore where a liner hanger is set in a well bore and where the liner hanger includes a polished bore receptacle having a bore with a polished internal bore section for cooperation with a sliding seal assembly and where an annular latching groove is located in a bore of the polished bore receptacle proximately above the upper end of the internal bore section and at the upper end of the polished bore receptacle, the improvement comprising:

a tubular member adapted for coupling with a string of tubing, said tubular member having a sliding seal assembly means at its lower end for cooperating with the polished bore section in the polished bore receptacle on the liner hanger for providing a sliding and sealing interrelationship therebetween;

said tubular member having a reduced diameter above said seal assembly means defining an open annular space between the tubular member and the bore of the polished bore receptacle, and where said annular space extends from the upper end of the polished bore receptacle to the seal assembly means;

means for releasably closing off the upper end of the polished bore receptacle above said seal assembly means relative to said tubular member yet permit a sliding relationship of said seal assembly means relative to the polished internal bore section comprising;

tubular cage means slidably disposed on said tubing member, said cage means having latching means adapted to releasably engage the annular latching groove in the upper end of the internal bore, means for resiliently actuating said latching means toward a position to engage the annular latching groove;

leaky seal means disposed on said cage means between said tubular member and said cage member and between said tubular member and the bore in the polished bore receptacle for closing off said open annular space yet permit a sliding relationship between said tubing member and said cage means when said latching means are in engagement with the annular latching groove thereby to prevent precipitation of materials in the well bore into the annular space;

said tubular member having a downwardly facing flange for moving said cage member and latching means into latching engagement with the annular latching groove, said tubular member having an upwardly facing flange proximately located above said seal assembly means for engaging said cage means for release of said latching means from the annular latching groove.

2. The tool as set forth in claim 1 wherein said latching means includes a plurality of elongated latch members disposed in a vertical relationship about the circumference of said cage means, and means for resiliently urging one end of said latch members outwardly for engagement with the annular latching groove.

3. The tool as set forth in claim 2 wherein the other end of said latch members is engaged is by annular retaining means which permits pivoting of said latch members relative to said cage means.

4. The tool as set forth in claim 1 wherein said latch members in an latching position have portions extending outwardly from said tubular member to engage the annular latching groove; and means on said tubular member having a diametral portion sized to be received between said cage member and said tubing member for moving said latch members to an unlatching position where said portions on said latch members are retracted into said cage means.

5. In a well tool for use in a well bore where the well tool has an upper tubular end with a bore and where an annular latching groove is located in the bore proximately to the terminal of the bore, the improvement comprising:

a tubular member adapted for coupling with a string of tubing, said tubular member being adapted for reception in the bore of the well tool;

said tubular member defining an open annular space between the tubular member and the bore of the well tool;

closure means for releasably closing off the bore in the upper end of the well tool relative to said tubular member yet permit a sliding or rotating relationship relative to the bore of the well tool, said closure means including tubular cage means slidably disposed on said tubing member, said cage means having latching means adapted to releasably engage the annular latching groove in the upper end of the bore in the well tool, means for resiliently actuating said latching means toward a position to engage the annular latching groove, and leaky seal means disposed on said cage means between said tubular member and said cage member and between said tubular member and the bore in the well tool for closing off said open annular space yet permit a sliding or rotational relationship between said tubing member and said cage means when said latching means are in engagement with the annular latching groove thereby to prevent precipitation of materials in the well bore into the annular space;

said tubular member having a downwardly facing flange for moving said cage member and latching means into latching engagement with the annular latching groove, said tubular member having an upwardly facing flange spaced apart from said downwardly facing flange for engaging said cage means for release of said latching means from the annular latching groove.

* * * * *